United States Patent [19]

Oeggerli

[11] Patent Number: 4,972,667

[45] Date of Patent: Nov. 27, 1990

[54] APPARATUS FOR AND METHOD OF STOPPING FIBER-MATERIAL FEED

[75] Inventor: Werner Oeggerli, Winterthur, Switzerland

[73] Assignee: Rieter Machine Works Limited, Winterthur, Switzerland

[21] Appl. No.: 388,027

[22] Filed: Jul. 31, 1989

[30] Foreign Application Priority Data

Aug. 4, 1988 [CH] Switzerland ..... 2957/88

[51] Int. Cl.[5] ..... D01H 13/16; D01H 13/18

[52] U.S. Cl. ..... 57/84; 57/83; 57/87; 19/0.25

[58] Field of Search ..... 57/80, 81, 83, 84, 87; 19/0.2, 0.25

[56] References Cited

U.S. PATENT DOCUMENTS

| | | | |
|---|---|---|---|
| 4,432,195 | 2/1984 | Stahlecker | 57/87 |
| 4,480,354 | 11/1984 | Glock et al. | 19/0.25 |
| 4,484,376 | 11/1984 | Glock et al. | 19/0.25 |
| 4,510,645 | 4/1985 | Glock | 19/0.25 |
| 4,538,328 | 9/1985 | Stahlecker | 19/0.25 |
| 4,630,434 | 12/1986 | Hartmannsgruber | 57/87 |
| 4,727,713 | 3/1988 | Konig et al. | 57/84 |

FOREIGN PATENT DOCUMENTS

| | | |
|---|---|---|
| 2952533 | 7/1981 | Fed. Rep. of Germany . |
| 3048481 | 7/1982 | Fed. Rep. of Germany . |
| 3100049 | 8/1982 | Fed. Rep. of Germany . |
| 3119408 | 12/1982 | Fed. Rep. of Germany . |
| 3145798 | 6/1983 | Fed. Rep. of Germany . |
| 3218660 | 8/1983 | Fed. Rep. of Germany . |
| 3226151 | 1/1984 | Fed. Rep. of Germany . |
| 3318925 | 11/1984 | Fed. Rep. of Germany . |
| 3327966 | 2/1985 | Fed. Rep. of Germany . |
| 3532541 | 3/1987 | Fed. Rep. of Germany . |
| 3606609 | 9/1987 | Fed. Rep. of Germany . |
| 1438276 | 6/1976 | United Kingdom . |
| 2090618 | 7/1982 | United Kingdom . |

*Primary Examiner*—Stuart S. Levy
*Assistant Examiner*—Steven M. DuBois
*Attorney, Agent, or Firm*—Sandler, Greenblum & Bernstein

[57] ABSTRACT

In the event of a yarn breakage the pressing roll of the inlet roll pair of a drafting arrangement is raised by a slubbing guide element from the inlet drafting roll or cylinder while simultaneously forming a clamping location for the slubbing or other fiber material.

7 Claims, 3 Drawing Sheets

Fig. 3
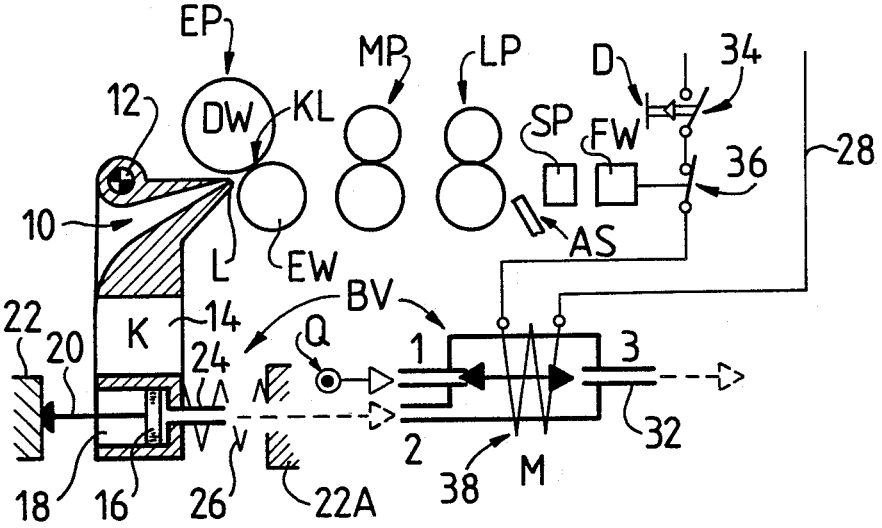
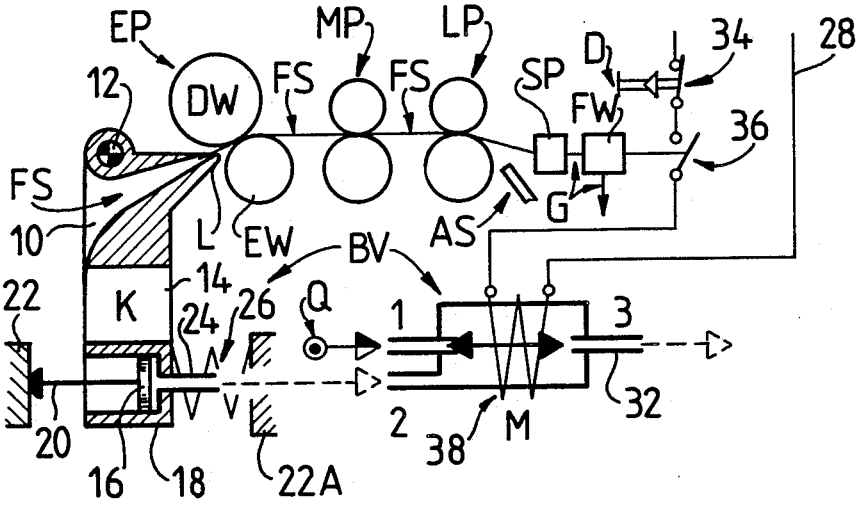
Fig. 4

Fig. 5
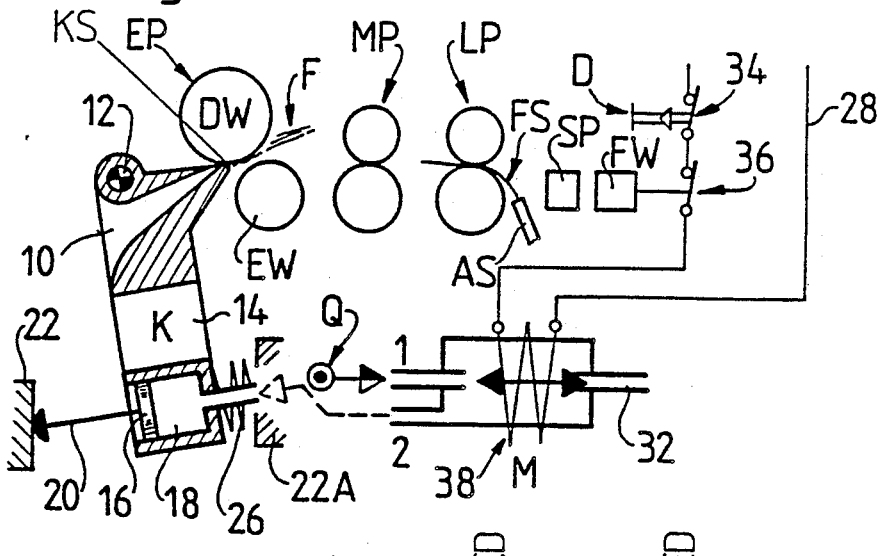
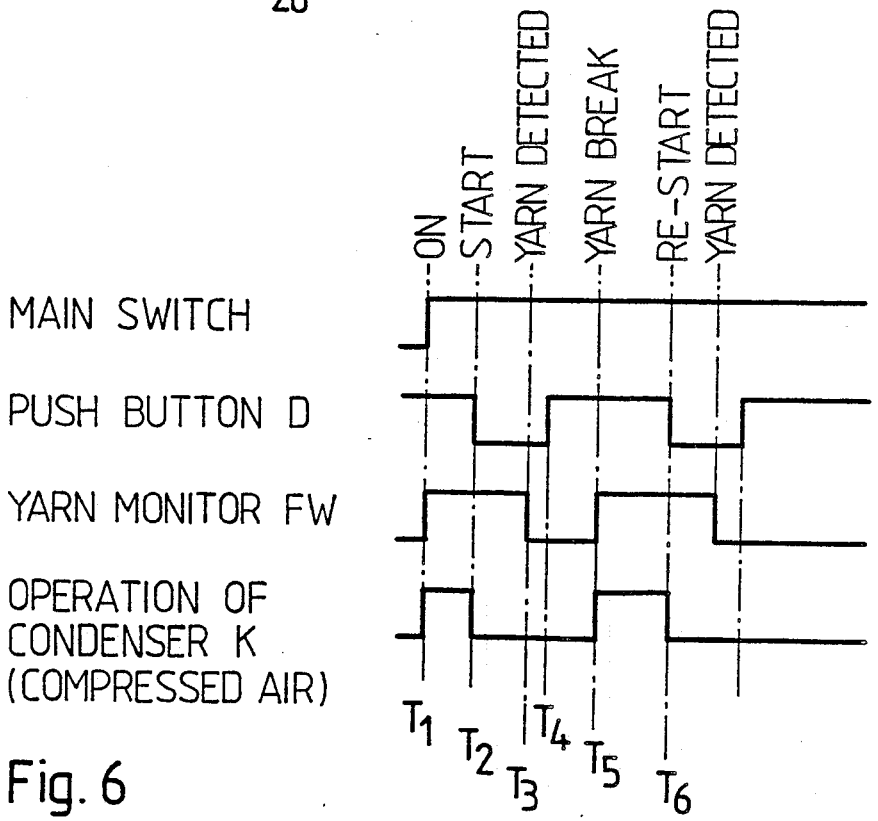
Fig. 6

APPARATUS FOR AND METHOD OF STOPPING FIBER-MATERIAL FEED

BACKGROUND OF THE INVENTION

The present invention broadly relates to a drafting arrangement of a spinning machine and, more specifically, pertains to a new and improved apparatus for stopping the feed of slubbing or other fiber material to a pair of inlet rolls of the drafting arrangement, the pair of inlet rolls comprising a driveable first roll and a second roll which is driveable by contact with the driveable first roll. The present invention also relates to a new and improved method for stopping slubbing or fiber-material feed.

Generally speaking, the new and improved construction of apparatus for stopping the feed of slubbing or other fiber material is of the type comprising means for forming a clamping location for the slubbing or other fiber material with the outer surface of the second roll, such means being at least substantially radially moveable relative to the second roll between a stand-by position and an operative position.

In spinning without opening or separation of the fiber material into individual fibers the fiber or fibrous material to be spun at an individual spinning station is normally supplied thereto by means of a drafting unit or arrangement, the latter comprising a plurality of roll or roller pairs. The fiber-material feed can be provided in the form of an untwisted strand, for instance a sliver, or a slightly twisted roving, for example, from the flyer. The term "slubbing" will hereinafter denote an elongate or rope-like or strand-like structure of fiber or fibrous material serving as feed for a spinning machine, irrespective of whether such feed is provided with a supporting twist or not.

When a yarn break or breakage occurs at a discrete spinning station the fiber-material feed thereat is advantageously interrupted upstream of the outlet or delivery roll or roller pair of the drafting unit or arrangement in order to reduce waste of fiber material and the risk that the slubbing, such as a roving, can wrap around an upper or lower delivery roll or roller in a fiber lap. For this purpose it is known to stop the inlet roll or roller pair of the drafting unit or arrangement in the event of a yarn break or breakage and to clamp the slubbing or other fiber material between the two inlet rolls or rollers. To resume spinning at this spinning station it is then only necessary to re-start or actuate the inlet roll or roller pair of the drafting unit or arrangement so that the previously clamped slubbing or other fiber material is again conveyed through the drafting unit or arrangement. However, for this purpose each inlet roll or roller pair of the entire drafting arrangement would have to be individually driven, in which event it would be impossible to use an uninterrupted or continuous drafting cylinder or roller such as in a ring spinning machine and relatively elaborate means would be required to disengage individual inlet roll or roller pairs from a common drive shaft.

It is also known in the event of a yarn break to move a clamping element into the converging space at the input side of the inlet roll or roller pair such that the slubbing or other fiber material is clamped between the clamping element and either one of the two inlet rolls or rollers. However, self-threading of the slubbing or other fiber material into the drafting unit or arrangement upon resumption of spinning is then no longer ensured and friction results between the clamping element and the drafting rolls or rollers as long as the yarn break has not been repaired, i.e. until clearance of the fiber-material feed stoppage.

It is known, for example, from German Published Pat. Application No. 2,952,533, published July 2, 1981 to raise the upper or pressing roll or roller away from the lower driven continuous inlet roll or cylinder in case of a yarn break or breakage and to clamp the slubbing or other fiber material at the raised and the now stationary upper or pressing roll or roller. The slubbing or other fiber material therefore remains threaded in the inlet roll or roller pair although the supply of slubbing or other fiber material to the respective spinning station has been interrupted. After clearance or elimination of the fiber-material feed stoppage and upon resumption of spinning, the raised upper or pressing roll or roller must be lowered to again engage with the lower driven continuous drafting roll or cylinder and the clamping action must be annuled. This known slubbing clamping device at the drafting unit of a spinning machine is relatively complicated and requires a corresponding constructional expenditure. Furthermore, the coordination of the various functions or operations is relatively difficult.

A further fiber-material stop mechanism is disclosed, for example, in British Pat. No. 1,438,276, published June 3, 1976. A pneumatic cylinder controls a ram. Extension of such ram causes it to trap the fibrous material at the pressing roller and then to move the latter away from the lower feed roller. The end of the ram is formed with a blade which is sufficiently narrow to engage flutes in the pressing roller and thus stop further rotation of the latter. This prior art construction is relatively complicated demanding a corresponding space requirement at the input side of the feed roller pair, the clamping location at the pressing roller being at a considerable distance from the nip line of the feed roller pair. Furthermore, the blade of the ram does not constitute a fiber-material guide element.

This basic principle of separating the inlet rolls or rollers which feed the fiber or fibrous material to the drafting arrangement or unit or, in other words, actuating a stop element in the event of a yarn break or breakage to move into the nip or press zone of the inlet roll or roller pair and to disengage them from one another, is also disclosed in the following publications of prior art:

1) German Pat. No. 3,100,049, published Aug. 5, 1982; German Pat. No. 3,145,798, published June 1, 1983 (Patent of Addition to aforesaid German Pat. No. 3,100,049); German Pat. No. 3,218,660, published Aug. 25, 1983 (Patent of Addition to aforesaid Pat. No. 3,100,049), German Published Pat. Application No. 3,226,151, published Jan. 19, 1984 (aforesaid Patent of Addition No. 3,145,798 is cited as prior art in this disclosure); and German Pat. No. 3,532,541, published Mar. 19, 1987, (aforesaid Patent of Addition No. 3,145,798 is cited as prior art in this disclosure):

A wedge-type element in the form of a shell or ring segment is rotatable at the lower inlet roll or roller. In the event of a yarn break, such shell or ring segment is rotated and moves with its front edge between the fiber material and the lower inlet roll or roller, thus clamping the fiber material and raising the upper inlet roll or roller. In another embodiment of the moveable stop element, the wedge-type element is a wedge-formed part which, in case of yarn breakage, is driven beneath the fiber stream or material and parallel thereto into the nip or press line of the inlet roll or roller pair. In this manner, the wedge-formed part clamps the sliver or roving against the upper roll or roller and raises the latter to be disengaged from the lower inlet roll or continuous cylinder.

2) German Published Pat. Application No. 3,048,481, published July 22 1982; German Published Pat. Application No. 3,119,408, published Dec. 9, 1982 (Patent of Addition to aforesaid Pat. No. 3,048,481); and German Published Pat. Application No. 3,606,609, published Sept. 3, 1987:

The lower inlet roll is partially encased by a clamp segment. When required because of yarn breakage, this clamp segment is rotated into its operative position and secures the sliver or roving at the upper inlet roll and raises the latter from the lower inlet roll.

3) German Published Pat. Application No. 3,318,925, published Nov. 29, 1984 and German Published Pat. Application No. 3,327,966, published Feb. 21, 1985:

A clamp member having an elastic wedge-shaped front blade is rotatably mounted at a pivot. In case of yarn breakage the clamp member with its front blade is pivoted in the direction of the nip line of the inlet roll pair and a sectionally reinforced clamp edge transversely arranged at the front blade traps the fibrous material against the upper or pressing roll or roller and moves the latter away from the lower inlet roll or drafting cylinder.

In all these cases the clamping and raising element performs a tangential or grazing movement with respect to the fiber or fibrous material as well as to the upper inlet roll or roller, and this tangential movement applies both to the clamping/raising operation as well as to the releasing/lowering operation. Under normal circumstances, the clamping or stop element is driven between the two inlet rolls or rollers as far as the normal nip line of the inlet roll or roller pair.

Despite these and other suggestions for an apparatus for stopping fiber-material feed and despite the obvious advantages which would be provided by such an apparatus, no existing or prior art construction as yet has proven to be a substantially optimized solution.

SUMMARY OF THE INVENTION

Therefore with the foregoing in mind it is a primary object of the present invention to provide a new and improved construction of an apparatus for stopping fiber-material feed, and which apparatus does not suffer from the aforementioned drawbacks and shortcomings of the prior art constructions.

Another and more specific object of the present invention aims at providing a new and improved apparatus for stopping the feed of slubbing or other fiber material to a pair of inlet rolls or rollers of the drafting unit or arrangement of a spinning machine and which apparatus renders possible the movement of the clamping-/raising and lowering/releasing element in a substantially radial direction relative to the upper or pressing inlet roll such that a clamping location of the slubbing or fiber material at the outer surface of the upper or pressing inlet roll is slightly offset from the nip line of the pair of inlet rolls. Furthermore, the clamping/raising and lowering/releasing element of the inventive apparatus provides guidance for the slubbing or other fiber material practically up to the nip line and possesses the shortest possible path of motion between the stand-by position and the operative position.

Yet a further significant object of the present invention aims a providing an new and improved apparatus for stopping slubbing or fiber-material feed to the drafting unit or arrangement of a spinning machine, and which apparatus is of very simple construction and design requiring a minimum of space, is relatively economical to manufacture, affords highly reliable operation without being readily subject to breakdown or malfunction, and requires a minimum of maintenance and servicing.

Now in order to implement these and still further objects of the present invention, which will become more readily apparent as the description proceeds, the apparatus of the present invention is manifested, among other things, by the features that the clamping means comprise a fiber-material guide element having at least one edge portion, such fiber-material guide element serving to guide the fiber material into the nip line of the pair of rolls. The fiber-material guide element is advantageously constructed and arranged to be moveable in the event of yarn breakage into the operative position which is, in fact, the fiber-material retaining or clamping position, such that the fiber-material guide element with its at least one edge portion clamps the fiber material at the clamping location and simultaneously substantially radially shifts the second roll or roller away from the first driveable roll or roller.

Advantageously, the fiber-material guide element is pivotably or rotatably mounted for pivotable or rotational motion between the stand-by position and the fiber-material retaining position. The fiber-material guide element preferably comprises a fiber-material condenser or funnel having a converging guide passage.

The fiber-material guide element is preferably movable between a stand-by position and an operative position, the guide element facilitating in its stand-by position the contact or engagement between the inlet rolls or rollers and rendering such contact or engagement ineffective in its operative or fiber-material retaining position. Preferably, the fiber-material guide element performs a pivotal or rotational motion between its stand-by and operative positions.

The clamping location for the slubbing or other fiber material, i.e. the location at which the slubbing or other fiber material is clamped between the fiber-material guide element and the upper or second roll or roller after disengagement of the inlet rolls or rollers, is normally slightly offset at the periphery of the upper or second roll or roller with respect to the nip line of the inlet roll or roller pair. In order to disengage the upper second roll or roller from the lower or first drivable roll or roller, the upper or second roll or roller is preferably moved along a path defining a substantially straight extension of a radius of the upper or second roll or roller extending through the clamping location.

The fiber-material guide element can be connected by means of a signal transmission system to a yarn monitor associated with the concerned individual spinning station or position so that during normal operation the fiber material guide element is actuated by the yarn monitor detecting a yarn break or breakage at the relevant spinning station or position. In addition, actuatable means can be provided to disconnect or disable yarn monitor operation at start-up of the spinning machine, if at start-up no yarn is present in the spinning station or position.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 3 schematically shows a side elevation, partially in section, of an exemplary embodiment of the apparatus illustrated in FIG. 3, constructed according to the invention and as schematically illustrated in FIG. 2;

FIG. 4 shows the exemplary embodiment of the apparatus illustrated in FIG. 3, but depicts a signal system in a different state or position;

FIG. 5 shows the exemplary embodiment of the apparatus in FIGS. 3 and 4 subsequent to disengagement of the upper inlet roll from the lower inlet roll; and FIG. 6 is a diagrammatic illustration of the operational stages of the signal system for the exemplary embodiment of apparatus shown in FIGS. 3, 4 and 5.

DETAILED DESCRIPTION OF THE PREFERRED EMBODIMENTS

Figure 1:
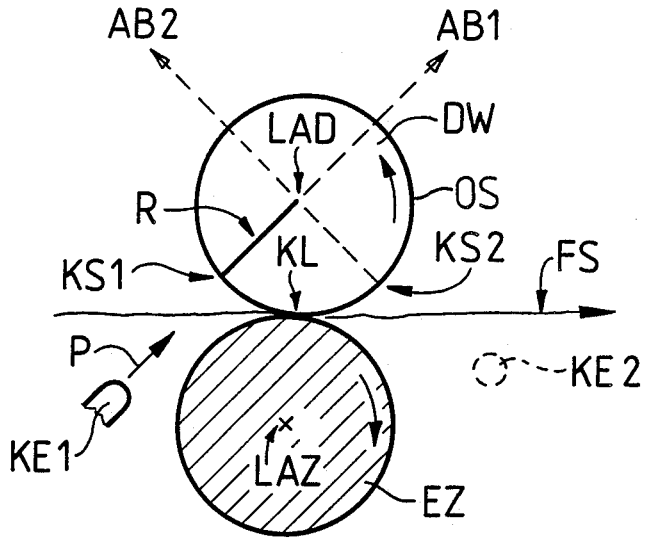
FIG. 1 is a schematic side view, partially in section, of a pair of inlet rolls or rollers of a drafting unit or arrangement and shows various possibilities for embodying the principles of the invention.

Describing now the drawings, it is to be understood that to simplify the showing thereof, only enough of the structure of the apparatus for stopping or interrupting fiber-material feed has been illustrated therein as is needed to enable one skilled in the art to readily understand the underlying principles and concepts of this invention. Turning attention now specifically to FIG. 1, an inlet roll or cylinder EZ and a pressing or upper roll or roller DW form the inlet roll or roller pair of a drafting unit or arrangement of a suitable spinning machine, for example, a ring or jet spinning machine, not particularly shown in the drawing. The inlet roll or cylinder EZ extends over several spinning positions or stations and possibly over one entire side of the spinning machine, i.e. the inlet roll or cylinder EZ is in the form of a continuous or uninterrupted roll or cylinder EZ. On the other hand, the pressing or upper roll or roller DW is associated with an individual spinning position or station not particularly shown in the drawing. In normal operation the pressing or upper roll or roller DW is pressed against the inlet roll or cylinder EZ so that the outer surfaces of the pressing or upper roll or roller DW and the inlet roll or cylinder EZ engage one another along a nip or press line KL. Preferably, the nip or press line KL extends substantially parallel to the longitudinal axis LAD of the pressing or upper roll or roller DW and to the longitudinal axis LAZ of the inlet roll or cylinder EZ.

The inlet roll or cylinder EZ is rotatably driven, clockwise as shown in FIG. 1, about its longitudinal axis LAZ by means of a suitable drive not particularly shown in the drawing. Due to the line contact between the pressing or upper roll or roller DW and the inlet roll or cylinder EZ, the rotation of the latter is transmitted to the pressing or upper roll or roller DW so that the latter rotates in anticlockwise direction about its longitudinal axis LAD. Slubbing or other fiber material can be introduced into the converging space at the input side of the pair of inlet rolls or rollers EZ and DW up to the nip or press line KL and, if the inlet roll or cylinder EZ is being driven, is drawn into the drafting unit or arrangement to produce a fiber material flow or stream FS therethrough. Since the other elements of the drafting unit or arrangement are of no relevance for understanding the present invention, they have not been included in the basic illustration of the inventive apparatus in FIGS. 1 and 2. In this manner, concentration can be focused on the relevant or essential elements.

As long as the operative elements of the spinning position or station operate normally in order to process the fiber material delivered by the drafting unit or arrangement into a yarn, the pressing or upper roll or roller DW remains in the position depicted in FIG. 1 in order to draw fiber material to be spun into the drafting unit or arrangement. However, when a yarn break occurs at this spinning position or station for any reason whatever, the fiber-material feed should be interrupted as close as possible to the inlet roll or roller pair EZ and DW. The apparatus constructed according to the invention renders possible such feed interruption in a particularly simple manner.

In a first variant a clamping element KE1 can be moved in the direction of the arrow P from a stand-by position toward the pressing or upper roll or roller DW in order to define a clamping location KS1 by contacting the outer surface OS of the pressing or upper roll or roller DW. The stand-by position of the clamping element KE1 is located on the upstream side of the fiber flow or stream FS with respect to the pressing or upper roll or roller DW. The transverse movement of the clamping element KE1 relative to the fiber flow or stream FS up to the clamping location KS1 first slightly deflects the fiber flow FS which is then clamped by the clamping element KE1 engaging with the pressing or upper roll or roller DW. Further movement of the clamping element KE1 in the same direction slightly disengages the pressing or upper roll or roller DW from the inlet roll or cylinder EZ. Since the inlet roll or cylinder EZ now ceases to drive the pressing or upper roll or roller DW, the latter being simultaneously braked by the clamping element KE1, the pressing or upper roll or roller DW stops almost immediately.

In the course of travel between the normal operating position shown in FIG. 1 and the raised position of the pressing or upper roll or roller DW, the longitudinal axis LAD thereof follows a path AB1 which is shown in broken lines and which represents an extension of a radius R of the pressing or upper roll or roller DW passing through the clamping location KS1. The support arrangement for the pressing or upper roll or roller DW must be appropriately constructed to render possible the travel thereof along the path AB1.

Since the subsequent drafting roll or roller pairs not particularly shown in the drawing of FIG. 1 are unaffected by the fiber-material clamping and pressing-roll raising operation, the fiber flow or stream FS provisionally continues to flow downstream from the clamping location KS1. The fibers thus delivered by the drafting unit or arrangement must be collected by a suitable extractor or suction device and removed. The fibers retained at the clamping location KS1 remain ready for resumption of spinning. When the yarn break or breakage has been cleared or repaired the clamping element KE1 can be returned to its stand-by position, the support arrangement of the pressing or upper roll or roller DW retuning the latter to its operative position in which it engages the inlet roll or cylinder EZ. When the nip or press line KL is again established, the fibers or fiber material at the clamping location KS1 are released by the clamping element KE1, such fibers or fiber material being located either in the newly formed nip or press line KL or in the converging space at the input side of the inlet roll or roller pair EZ and DW. In the latter case such fibers or fiber material are immediately conveyed by the inlet roll or cylinder EZ to the nip or press line KL so that the now released slubbing or other fiber material is drawn into the drafting unit or arrangement. Therefore, the system is self-threading.

As already mentioned hereinbefore, the clamping location KS1 is located at the input side of the inlet roll or roller pair, but this feature is not essential for the apparatus constructed according to the invention. A clamping element KE2 could be arranged at the output side of the inlet roll or roller pair in order to form a corresponding clamping location KS2 in the diverging space of the inlet roll or roller pair EZ and DW. In this case the longitudinal axis LAD of the pressing or upper roll or roller DW preferably would be moved along a path AB2 between the operative position and the disengaged position in order to move the pressing or upper roll or roller away from the inlet roll or cylinder EZ. However, for reasons of space the solution with the clamping element KE1 at the input side of the inlet roll or roller pair EZ and DW is usually preferred.

Figure 2:
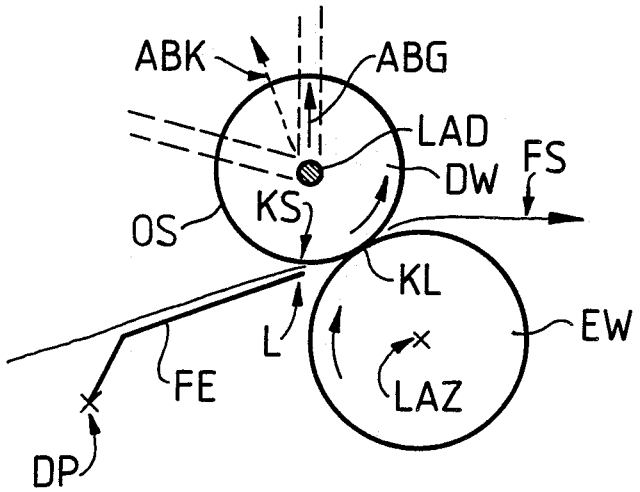
FIG. 2 shows a schematic side elevation of a constructionally advantageous embodiment of the principles of the invention shown in FIG. 1.

FIG. 2 shows a variant of the embodiment of the clamping element. In this case the pressing or upper roll or roller DW cooperates with a driven inlet roll or roller EW which is individually associated with the respective spinning station or position, i.e. not extending across several spinning stations or positions. The fiber flow or stream FS is guided from the not particularly shown fiber-material feed by means of a guide element FE to the nip or press line KL of the inlet roll or roller pair. The guide element FE is pivotably or rotatably mounted for pivoting about a pivot DP and can be pivoted by any suitable means (not shown) about the pivot DP from a fiber-material guiding position depicted in FIG. 2, into an intermediate position in which an edge L at the front end of the guide element FE engages the pressing or upper roll or roller DW to form the clamping location KS. Further movement of the clamping element FE disengages the pressing or upper roll or roller DW from the driven inlet roll or roller EW, the longitudinal axis LAD of the pressing or upper roll or roller being adapted to follow either a straight path ABG or a curved path ABK.

As in the case of the arrangement depicted in FIG. 1, the clamping location KS in FIG. 2 is slightly offset with respect to the nip or press line KL in the circumferential direction of the pressing or upper roll or roller DW, so that upon return travel of the pressing or upper roll or roller DW the fibers clamped at the clamping location KS are either already located in the nip or press line KL or can be rapidly guided into the latter by the driven inlet roll or roller EW. To simplify the construction the longitudinal axis LAD of the pressing or upper roll or roller DW is no longer vertically arranged above the longitudinal axis LAZ of the driven inlet roll or roller EW as in FIG. 1, but is offset in the upstream direction in order to give the pressing or upper roll or roller DW a slight "overhang" with respect to the driven inlet roll or roller EW. A similar arrangement of the inlet rolls DW and EW is also shown in FIGS. 3, 4 and 5.

FIG. 3 shows an inlet roll or roller pair EP, an intermediate roll or roller pair MP and an exit or delivery roll or roller pair LP of a two-zone drafting unit or arrangement. The fiber material delivered by the latter is conveyed to a schematically depicted spinning position or station SP and processed at that location into a yarn G (FIG. 4) by not particularly shown but conventional operating elements of the spinning position or station SP, such as the spindle and ring and traveller combination of a ring spinning machine or the appropriate jet arrangement of a jet spinning machine or the combination of a fiber collector together with a mechanical false twist inserter in an OE-false twist machine. The fiber material to be spun is conveyed in operation to the inlet roll or roller pair EP by means of a guide passage 10 of a condenser K. As previously mentioned hereinbefore, this fiber material is drawn in from a not particularly shown fiber material feed, such as a supply a bobbin or a can, by the inlet roll or roller pair EP into the drafting unit or arrangement.

According to the schematically depicted principle of the pivotable guide element FE in FIG. 2, the condenser K is rotatably mounted at a pin or pivot 12. Furthermore, the condenser K is provided with a cantilever arm 14 which at its end remote from the pin or pivot 12 cooperates with an actuating device BV.

This actuating device BV comprises a chamber 18 which is accommodated by the cantilever arm 14 and contains a piston 16. This piston 16 is connected by means of a piston rod 20 to a stationary part 22 of the machine frame not particularly shown in further detail. A compressed air line or conduit 24 extends into that end of the chamber 18 which is remote from the stationary part 22. When air at an appropriate pressure is supplied through the compressed air line or conduit 24 to the chamber 18, the cantilever arm 14 pivots in anticlockwise direction as viewed in FIG. 3 about the pin 12 in order to bring the outlet of the condenser K into contact with the pressing or upper roll or roller DW of the inlet roll or roller pair EP, the compressed air acting against the bias exerted by a compression spring 26. This compression spring 26 is located between the chamber 18 and a further stationary part 22A of the machine frame. However, when compressed air is not being supplied, the cantilever arm 14 and the condenser K are retained by the compression spring 26 in a normal or operative position depicted in FIGS. 3 and 4. In this operative position the condenser K, i.e. the guide passage 10, extends into the converging space at the input side of the inlet roll or roller pair EP without contacting the pressing or upper roll or roller DW, so that the fiber flow or stream FS shown in FIG. 4 can flow unhindered through the drafting unit or arrangement.

When the condenser K is in its normal or operative position, the piston 16 is disposed at that end of the chamber 18 which is remote from the stationary part 22 as shown in FIGS. 3 and 4. At the end of rotational travel of the condenser K effected by compressed air, the piston 16 is located at that end of the chamber 18 which faces the stationary part 22 as shown in FIG. 5. The not particularly shown connection between the piston rod 20 and the stationary part 22 must be structured such that it renders possible the necessary pivoting motion of the cantilever arm 14. During this pivoting movement from the fiber-material feed position depicted in FIG. 4 into the operative position depicted in FIG. 5, the edge L of the condenser K forms a clamping location KS with the pressing or upper roll or roller DW, the formation of this clamping location KS occurring before completion of the aforesaid pivoting movement. Further pivoting of the condenser K after formation of the clamping location KS disengages and raises the pressing or upper roll or roller DW from the driven inlet roll or roller EW. The roll contact forming the nip or press line KL between the pressing or upper roll or roller DW and the driven inlet roll or roller EW is thus eliminated. The chamber 18, in operation, remains without compressed air as long as the spinning position or station SP is processing fiber material FS into yarn G or the like. A yarn monitor FW continuously monitors the production of yarn G in the spinning position or station SP. In the event yarn production is interrupted in this spinning position or station SP the yarn monitor FW triggers, via a signal line 28 and a compressed air valve M reacting thereto, the supply of compressed air from an appropriate source Q through the line or conduit 24 into the chamber 18, thus triggering or initiating the pivoting movement of the condenser K.

After occurrence of a yarn break or breakage the drafting unit or arrangement provisionally continues to supply fiber material. The supplied fiber material is removed by any suitable extractor AS, such as a suction device or nozzle, associated with the exit or delivery roll or roller pair LP. After formation of the clamping location KS and raising of the pressing or upper roll or roller DW, further entry of fiber material from the material feed into the drafting unit is interrupted. The material already present in the drafting unit or arrangement is conveyed by the intermediate roll or roller pair MP and the exit or delivery roll or roller pair LP to the extractor AS. The fibers retained at the clamping location KS (FIG. 5) cannot participate in this fiber flow or stream FS so that this fiber flow or stream FS is interrupted in the preliminary drafting zone between the inlet roll or roller pair EP and the intermediate roll or roller pair MP, the fibers F remaining "threaded" in the inlet roll or roller pair EP.

When the yarn break has been cleared or repaired the compressed air valve M is reset to interrupt the supply of compressed air from the source Q to the line or conduit 24 and to vent the chamber 18 by means of the line or conduit 24 and a further line or conduit 32. The cantilever arm 14 and the condenser K can therefore return to the operative or fiber-material feed position, shown in FIGS. 3 and 4, by virtue of the bias exerted by the compression spring 26. The nip or press line KL is therefore re-established by remaking contact between the pressing or upper roll or roller DW and the driven inlet or lower roll or roller EW and, almost simultaneously, the previously retained fibers F are released by eliminating the clamping location KS, leading to the resumption of fiber-material feed into the drafting unit or arrangement in order to restore the fiber stream or flow FS. The arrangement is therefore self-threading.

The negative pressure associated with the extractor AS can cease simultaneously with the restoration of fiber feeding so that the newly delivered fibers are conveyed to the prepared or operationally ready spinning position or station SP. The extractor AS can be reconnected to a not particularly shown negative pressure source in the event of the yarn monitor FW detecting a further yarn break or breakage.

The aforesaid signal line 28 comprises a switch 34 actuatable by a push button D, a switch 36 actuatable by the yarn monitor FW and a coil or winding 38 operating the compressed air valve M. The functions of various cooperating or coacting elements in FIGS. 3, 4 and 5 will be described in greater detail hereinafter with reference to the signal diagram depicted in FIG. 6.

Actuation of a not particularly shown main or master switch sets the complete machine in operation. Consequently and as shown in FIG. 6, current is applied to the signal line 28 at the moment of time T1.

At this time the switch 34 is closed since the push button D has not yet been actuated, and the switch 36 is closed since no yarn is present in the yarn monitor FW.

Therefore, the coil or winding 38 actuates the solenoid valve M so that compressed air from the source Q is delivered to the chamber 18. Accordingly, the condenser K is immediately moved from the normal or stand-by position shown in FIG. 3 into the operative position shown in FIG. 5 in order to raise the pressing or upper roll or roller DW from the driven inlet roll or roller EW and clamp to the fibers F still threaded in the pressing or upper roll or roller DW and the inlet roll or roller EW. The state of the main or master switch is shown in the top row or line of the signal diagram in FIG. 6, the state of the push button D is shown in the second row or line from the top, the state of the yarn monitor FW is shown in the third row or line from the top and the state of the chamber 18 and thus the operating position of the condenser K is shown in the bottom row or line.

When the spinning position or station SP is ready for spinning, the push button D is operated (FIG. 3) to de-energize the coil or winding 38 associated with the solenoid valve M. The supply of compressed air to the chamber 18 is thus interrupted, causing the condenser K to return to the normal or stand-by position thereof. However, since no yarn is passing through the yarn monitor FW, the switch 36 remains closed, corresponding to the moment of time T2 in FIG. 6.

After the spinning position or station SP has resumed processing newly supplied fiber material into a yarn G, the yarn monitor FW detects the presence of such yarn G and opens the switch 36 at the moment of time T3 in FIG. 6. Shortly afterwards at the moment of time T4 the push button D can be released, for example, by a suitable and thus not shown time relay in order to close the switch 34 (FIG. 4). The complete arrangement has now reached the normal operating condition and is ready to react to any yarn break or breakage, for example, at the moment of time T5 with the opening of the switch 36 by the yarn monitor FW.

After the spinning position or station SP has been made ready to re-start by the operating personnel either manually or automatically, re-starting can be initiated or triggered by actuating the push button D at the moment of time T6. Since the procedure for piecing after a yarn breakage is exactly the same as the procedure for restarting spinning after stoppage of the machine, this sequence of operations already hereinbefore described for the resumption of spinning will not be repeated.

The present invention is not limited to details of the exemplary embodiment shown in FIGS. 3, 4 and 5. The moveable clamping element has been shown in the preferred embodiment as a yarn-guiding element, preferably as the pivotal slubbing or fiber-material condenser K. Yet it is not absolutely necessary for the movement of the clamping element from its stand-by position to the operative position to be a pivoting movement. The same effect could be achieved by a linear movement of the clamping element. However, the preferred variant providing pivoting movement is advantageous, more particularly with regard to the arrangement disclosed in the previously discussed German Published Pat. Application No. 2,952,533, because the number of operating elements and the operating distances can be small, thus providing a compact and simple arrangement. Another advantage provided by the invention is that the formation of the clamping location and the disengagement of the two inlet rolls or rollers DW and EW occur substantially simultaneously, thus ensuring that severance of the fiber flow or stream FS occurs subsequent to formation of the clamping location KS and downstream of the latter. Since the clamping location KS is formed close to the nip or press line KL, the retained fibers remain ready to start infeeding the fiber material.

The pressing or upper roll or roller DW can be structured as a double roll or roller unit, the rolls of a single unit being associated with adjacent spinning positions. This arrangement is familiar for ring spinning and so will not be described here in further detail.

According to the present invention, in contrast to the arrangement disclosed in the aforesaid German Published Pat. Application No. 2,952,533 the clamping forces exerted on the outer surface of the pressing or upper roll or roller DW are used to lift the latter and thus to disengage the pressing or upper roll or roller DW from the driven inlet roll or roller EW.

In several aforementioned prior art devices the clamping and disengaging element performs a "grazing" or tangential movement relative to the pressing or upper roll or roller for both disengaging and returning the pressing or upper roll or roller. Under normal circumstances the clamping element is moved up to the normal nip line of the inlet roll or roller pair.

In the system according to the present invention the elongate feed material experiences no grazing action by the clamping element. The clamping element moves in a substantially radial direction relative to the pressing or upper roll or roller for the clamping/disengaging movement as well as for the returning/releasing movement. The clamping location is slightly offset with respect to the nip or press line and therefore, despite the relatively short path of travel of the clamping element, is accessible without substantial tangential movement of the clamping element.

The preferred exemplary embodiment of the apparatus constructed according to the invention uses the condenser or yarn guiding element as the clamping element and thus renders possible a very compact and simple construction. For this purpose, a condenser which encloses or surrounds the slubbing or other fiber material preferably opens to the pressing or upper roll or roller to facilitate the formation of a clamping edge at the condenser. By using the yarn guide as the clamping element, the latter in its stand-by or yarn guiding position can be closely arranged to the pressing or upper roll or roller and the clamping location, respectively.

While there are shown and described present preferred embodiments of the invention, it is to be distinctly understood that the invention is not limited thereto, but may be otherwise variously embodied and practiced within the scope of the following claims.

Accordingly, what I claim is:

1. An apparatus for stopping fiber-material feed to a pair of rolls having a first driveable roll and a second roll engaging the fiber material therebetween and defining a nip line, said second roll having an outer surface and being driveable by contact of said outer surface with said first driveable roll, said apparatus comprising:

clamping means for defining a fiber-material clamping location with said outer surface of said second roll;

said clamping means having a stand-by position and an operative position;

said operative position defining a fiber-material retaining position;

means for moving said clamping means approximately radially with respect to said second roll between said stand-by position and said fiber-material retaining position;

said clamping means comprising a fiber-material guide element having at least one edge portion;

said fiber-material guide element serving to guide the fiber material into the nip line of said pair of rolls;

means for mounting said fiber-material guide element for pivotable movement between said stand-by position and said fiber-material retaining position; and said fiber-material guide element comprising a fiber-material condenser having a converging guide passage.

2. The apparatus as defined in claim 1, further including:

means for enabling said fiber-material condenser to be movable in the event of yarn breakage into said fiber-material retaining position such that said at least one edge portion of said fiber-material condenser clamps the fiber material at said clamping location and simultaneously moves said second roll away from said first driveable roll.

3. The apparatus as defined in claim 1, wherein:

said first driveable roll and said second roll of said pair of rolls constitute an inlet roll pair of a drafting arrangement.

4. The apparatus as defined in claim 3, wherein:

said inlet roll pair possesses an upstream side; and said fiber-material guide element being arranged at said upstream side of said inlet roll pair.

5. The apparatus as defined in claim 4 in combination with a spinning station and a yarn monitor for monitoring yarn produced by said spinning station, wherein:

said yarn monitor supplies a yarn-break signal in the event of yarn breakage at said spinning station; and the movement of said fiber-material guide element from said stand-by position to said fiber-material retaining position being triggered by said yarn-break signal from said yarn monitor.

6. A method of stopping fiber-material feed to a pair of rolls, comprising the steps of:

guiding the fiber material by means of a guide element in order to convey the fiber material into a nip line of the pair of rolls;

controllably moving the guide element toward a predetermined clamping location on the outer surface of one roll of the pair of rolls; and clamping the fiber material at the predetermined clamping location by means of the moving guide element and thus inhibiting further movement of the fiber material.

7. The method as defined in claim 6, further including the step of:

moving said one roll of the pair of rolls away from the other roll of the pair of rolls by means of a clamping force exerted on said one roll of the pair of rolls by the moving guide element.

* * * * *